United States Patent [19]

Swarbrick

[11] 4,190,822

[45] Feb. 26, 1980

[54] CURRENT TELEMETERING INTERFACE APPARATUS

[75] Inventor: Richard Swarbrick, Glasgow, Scotland

[73] Assignee: Honeywell Inc., Minneapolis, Minn.

[21] Appl. No.: 893,665

[22] Filed: Apr. 5, 1978

[51] Int. Cl.[2] ..... G08C 19/00; G05F 1/10

[52] U.S. Cl. ..... 340/210; 323/9; 323/63; 323/74; 323/94 R

[58] Field of Search ..... 340/210, 177 R; 330/1 A, 288, 293, 105; 323/1, DIG. 1, 74, 63, 94 R, 9

[56] References Cited

U.S. PATENT DOCUMENTS

| | | | |
|---|---|---|---|
| Re. 27,596 | 3/1973 | Hurd | 340/210 |
| 3,387,266 | 6/1968 | Swartwout et al. | 340/210 |
| 3,684,924 | 8/1972 | Miller | 340/210 |
| 4,001,703 | 1/1977 | Saul et al. | 330/1 A |

*Primary Examiner*—John W. Caldwell, Sr.
*Assistant Examiner*—James J. Groody
*Attorney, Agent, or Firm*—Laurence J. Marhoefer; Lockwood D. Burton

[57] ABSTRACT

An interface circuit in a current telemetering system includes first and second current loops connected in parallel between a pair of energizing terminals. The first loop includes a voltage controlling transistor, resistors, a current controlling transistor, and a current receiver connected in series between the energizing terminals. The second loop includes the voltage controlling transistor, a resistor, a Zener diode intrinsic safety barrier, a two-wire link, and a current transmitter connected in series between the energizing terminals. A first amplifier senses the currents in the two loops and controls the current controlling transistor to keep the current in the first loop and the receiver proportional to the current in the second loop as established by the transmitter. A second amplifier monitors the voltage at a point in the first loop and controls the voltage controlling transistor so as to keep the voltage at that point constant at a predetermined value. This, in turn, maintains a corresponding constant voltage at a corresponding point in the second loop, such as a point within the barrier. The specific position of that point in the second loop is set, to prevent the undue limiting of the voltage at the transmitter, by giving a corresponding resistance value to the one of the resistors in the first loop which is adjacent to the noted point in the first loop.

7 Claims, 1 Drawing Figure

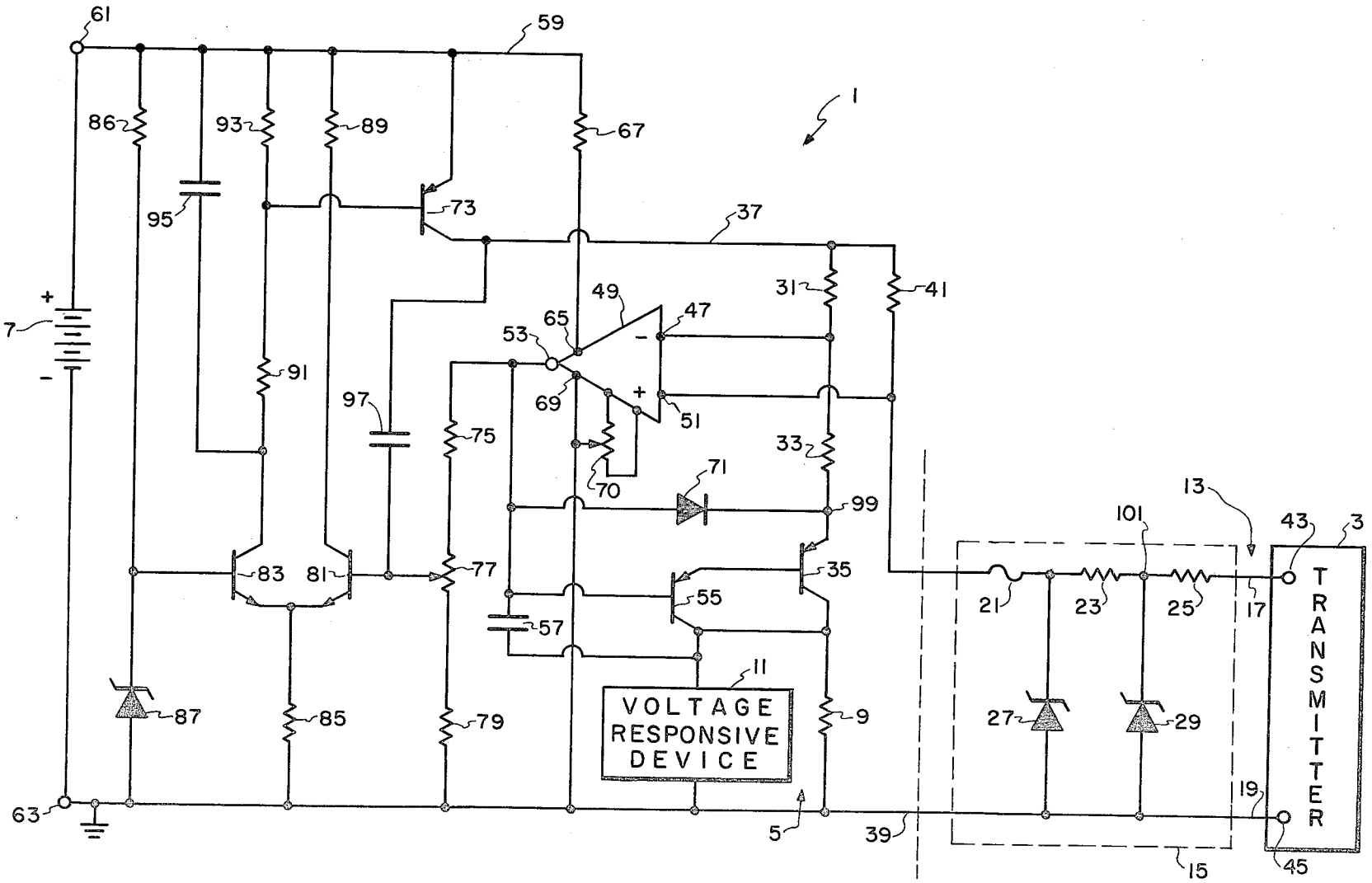
TRANSMITTER
VOLTAGE RESPONSIVE DEVICE

CURRENT TELEMETERING INTERFACE APPARATUS

BACKGROUND OF THE INVENTION

1. Field of the Invention

The present invention relates generally to current telemetering apparatus wherein a receiver is connected to a remotely located transmitter by means of a two-wire transmission line or link. Specifically, the invention relates to interface apparatus which is commonly connected between such a receiver and its associated two-wire link and transmitter to supply the necessary energizing power to the system and to provide needed interfacing between the receiver and the two-wire link and transmitter.

2. Description of the Prior Art

It is well known in connection with the practice of current telemetering, particularly in the field of industrial process control, to provide a process condition transmitter, including a process condition value sensor, at the remote location at which the sensed condition exists, and to utilize a two-wire link to connect such a remotely located transmitter to a receiver which is located in a central control area. It is also well known to construct and energize such apparatus so that a current flows around the series path or loop including the transmitter, the two-wire link, and the receiver, and so that the transmitter causes the value of that current to be a desired function of the value of the sensed condition. The receiver in such known systems is constructed to translate the value of the loop current into an indication, record, and/or control function which represents the sensed value of the condition. It is further well known to utilize a power supply or current source at the receiver location to produce the loop current, and to utilize this current, by way of the two-wire link, to provide at the transmitter all of the power required to energize the latter. In so doing, the power supply at the receiver delivers a voltage to the two-wire link which produces the transmitter supply voltage at the transmitter. An example of such a current telemetering system, wherein the transmitter receives its supply voltage over the two-wire link, is the system disclosed in the Hurd U.S Pat. No. Re.27,596.

It has been found in practice to be desirable to include intrinsic safety Zener barriers in systems of the type described above in order to prevent the production of unsafe conditions in the vicinity of the portion of the current loop which includes the two-wire link and the transmitter. Such a Zener barrier usually consists of first and second stages, each of which includes a Zener diode. The known operating theory of such barriers requires that the Zener voltage rating of the second stage diode of a barrier be less than the Zener voltage rating of the first or input stage diode of that barrier.

In a system of the type just described, it has also been found to be desirable to provide interface apparatus between the power supply, the receiver, and the barrier/ two-wire link/transmitter portion of the system. An example of such interface apparatus, used in a current telemetering system including a Zener barrier as described above, is the apparatus which is disclosed in the Saul et al. U.S. Pat. No. 4,001,703, wherein the desired interfacing is accomplished by the use of a so-called current mirror circuit. As explained in that patent, such interface apparatus provides desired flexibility in regard to the supplying of the power to the system, in regard to grounding procedures for the system components, and in regard to the number of barriers required.

When interface apparatus of the above-noted type is employed in a system as just described, the voltage applied across the two-wire link by the interface apparatus is the source of the supply voltage at the transmitter. This applied voltage is by no means constant, and has been found in practice to exhibit excursions which cause the conduction or tripping of one or more of the barrier Zener diodes. Such diode tripping is undesirable, since it interrupts the system operation.

It has, therefore, been suggested to employ interface circuitry which holds the voltage at the barrier input constant at a value which prevents such diode tripping. This procedure has the practical disadvantage of unduly limiting the supply voltage available at the transmitter. This is so because the lower Zener voltage rating of the second stage barrier diode requires that the constant voltage at the barrier input, and hence the transmitter supply voltage, be kept lower than they would have to be if the point of controlled voltage were elsewhere, such as at the second stage barrier diode. This restricting of the transmitter voltage is undesirable, since it is desirable to have the transmitter voltage as high as the parameters of the system will permit.

It has been suggested previously to use a voltage regulated power supply for the entire telemetering system. This has the disadvantage of not necessarily preventing tripping of the barrier diodes.

SUMMARY OF THE INVENTION

Accordingly, it is an object of the present invention to provide an improved interface apparatus for a current telemetering system which does not produce the undesirable operation referred to above. Thus, it is a specific object of the invention to provide an improved interface apparatus, for use in a current telemetering system, which prevents voltage excursions in the system, such as those which would cause the tripping of intrinsic safety barrier Zener diodes included in the system, without unduly limiting the supply voltage for the transmitter.

To the end of accomplishing the above-noted and other desirable objects, the improved interface apparatus according to the invention establishes a receiver or first current loop and a transmitter or second current loop, and holds the voltage constant at a point in the transmitter loop which will be referred to herein as the transmitter loop point. The point chosen to be the transmitter loop point is advantageously that point at which the voltage ceiling for preventing barrier diode tripping is the lowest, and may well be at the above-noted second stage diode of the barrier. The value at which the voltage at the transmitter loop point is held constant is desirably made to be just low enough to prevent barrier diode tripping, whereby the transmitter receives the highest possible value of supply voltage, and that voltage is thus not unduly limited.

The improved interface apparatus accomplishes the operation just described by causing the value of the receiver loop current to follow the value of the transmitter loop current as established by the transmitter, by providing a controllable voltage dropping device, such as a transistor, which is common to both of said loops, by controlling that voltage dropping device to keep the monitored voltage at a receiver loop point constant, thereby to keep the voltage at the transmitter loop point correspondingly constant, and by including resistance means at the receiver loop point whose resistance value determines the location of the transmitter loop point in that loop.

BRIEF DESCRIPTION OF THE DRAWING

A better understanding of the present invention may be had from the following detailed description when read in connection with the accompanying drawing, wherein the single FIGURE shows the schematic circuit diagram of a current telemetering arrangement employing a preferred form of interface apparatus according to the present invention.

DETAILED DESCRIPTION OF THE ILLUSTRATED APPARATUS

The purpose of the illustrated preferred form of interface apparatus chosen to exemplify the improved apparatus according to the present invention is to so interface the several portions of a Zener barrier-protected current telemetering system that the transmitter supply voltage has the highest possible value for the particular system parameters, and thus is not unduly limited. This desired result is provided by the illustrated interface apparatus by so arranging the latter that the transmitter loop point—the point at which the apparatus maintains a constant voltage in the transmitter or second loop—is the point therein at which the voltage ceiling for preventing barrier diode tripping is the lowest. In the illustrated apparatus, it is assumed by way of example that the Zener voltage rating of the second stage barrier diode is less than that of the first or input stage diode, that the transmitter loop point is thus caused to be at that second stage diode, and that the voltage at the transmitter loop point is kept constant at a value which just prevents tripping of the second stage diode.

In accordance with the foregoing, the interface apparatus is shown at 1 in the drawing as being included in a current telemetering system which also includes a current transmitter 3, a current receiver 5, and a power supply or current source, shown as a battery 7. The transmitter 3 may well be of the type which is disclosed in the above-noted Hurd patent. The receiver 5 is shown as including a resistor 9 and a voltage responsive device 11 which is connected across the resistor 9. The device 11 may be a conventional voltage responsive indicator, recorder, and/or control device which is responsive to the voltage drop produced across the resistor 9 by current which flows through that resistor. It is to be understood, however, that the current receiver 5 could consist of simply a conventional current responsive device, such as a milliammeter, in lieu of the resistor 9 and device 11.

The illustrated telemetering system also includes a two-wire transmission line or link 13, and a Zener diode intrinsic safety barrier 15. The link 13 consists of conductors 17 and 19. The barrier 15 is of conventional form, and includes the usual series-connected fuse 21 and resistors 23 and 25, and the usual shunt-connected Zener diodes 27 and 29.

A current controlling portion of the current mirror type is included in the illustrated apparatus and includes a series circuit consisting of a resistor 31, a resistor 33, the emitter-collector path of a PNP transistor 35, and the receiver resistor 9 connected in series, in the order stated, between a conductor 37 and a common conductor 39. The latter is connected to ground and extends through the barrier 15 to the link conductor 19. Thus, as shown in the above-noted Saul et al patent, the conductor 19 may simply be ground, if desired, instead of metallic.

A resistor 41 is connected between the conductor 37 and the barrier fuse 21 which, in turn, is connected through the barrier resistors 23 and 25 and the link conductor 17 to one terminal 43 of the transmitter 3. The remaining terminal 45 of the transmitter 3 is connected to the conductor 19. The Zener diode 27 is connected between the conductor 39 and the junction between the fuse 21 and the resistor 23, and the Zener diode 29 is connected between the conductor 39 and the junction between the resistors 23 and 25. This junction is at a point 101.

The inverting input terminal 47 of an operational amplifier 49 is connected to the junction between the resistors 31 and 33. The non-inverting input terminal 51 of the amplifier 49 is connected to the junction between the resistor 41 and the fuse 21. The output terminal 53 of the amplifier 49 is connected to the base of a PNP transistor 55 which cooperates with the transistor 35 to form a Darlington pair. Accordingly, the emitter of the transistor 55 is connected to the base of the transistor 35, and the collectors of the transistors 35 and 55 are connected together. As previously noted, the receiver voltage responsive device 11 is connected across the resistor 9. A bypass capacitor 57 is connected between the collector and base of the transistor 55.

The illustrated apparatus also includes a positive supply conductor 59 which is connected through a positive supply terminal 61 to the positive terminal of the battery 7. The negative terminal of the latter is connected by way of a negative supply terminal 63 to the common conductor 39. The amplifier 49 has a positive energizing terminal 65 which is connected through a resistor 67 to the positive supply conductor 59. The amplifier 49 also has a negative energizing terminal 69 which is connected to the common conductor 39, to which is also connected the adjustable contact of a balancing resistor 70 which is connected to the amplifier 49 in the usual manner. A diode 71 is connected between the amplifier output terminal 53 and the junction between the resistor 33 and the emitter of the transistor 35.

The current controlling portion of the apparatus as just described is like the current controlling portion of the apparatus disclosed in the above-noted Saul et al patent.

The apparatus 1 also includes a voltage controlling portion which, in turn, includes a PNP transistor 73. The latter has its emitter connected to the conductor 59, and has its collector connected to the conductor 37. The voltage drop appearing between the emitter and the collector of the transistor 73, and hence appearing between the conductor 59 and the conductor 37, is controlled by a circuit which is connected to the base of the transistor 73. That circuit includes resistors 75, 77, and 79 which are connected in series, in the order stated, between the base of the transistor 55 and the common conductor 39. An adjustable contact on the resistor 77 is connected to the base of an NPN transistor 81, the emitter of which is connected to the emitter of a second NPN transistor 83. The transistors 81 and 83 form a long-tailed pair. The connected emitters of the transistors 81 and 83 are connected through a resistor 85 to the common conductor 39. A resistor 86 and a Zener diode 87 are connected in series, in the order stated, between the conductor 59 and the conductor 39. The junction between the resistor 86 and the Zener diode 87 is connected to the base of the transistor 83 to establish a constant reference voltage on that base.

The collector of the transistor 81 is connected to the conductor 59 through a resistor 89. The collector of the transistor 83 is connected through series-connected resistors 91 and 93 to the conductor 59, and the junction between the resistors 91 and 93 is connected to the base of the transistor 73. A bypass capacitor 95 is connected between the collector of the transistor 83 and the conductor 59, and a bypass capacitor 97 is connected between the collector of the transistor 73 and the base of the transistor 81.

By virtue of the construction just described, the illustrated apparatus contains two current paths or loops for which the voltage-controlling transistor 73 is a common element. Specifically, the first of these current loops can be traced from the positive supply terminal 61 through the emitter-collector path of the transistor 73, the conductor 37, the resistor 31, the resistor 33, the emitter-collector path of the current-controlling transistor 35, the receiver resistor 9, and the common conductor 39 back to the negative supply terminal 63. Similarly, the second current loop can be traced from the positive supply terminal 61 through the emitter-collector path of the transistor 73, the conductor 37, the resistor 41, the barrier elements 21, 23, and 25, the link conductor 17, the transmitter 3, and the common conductors 19 and 39 back to the negative supply terminal 63.

OPERATION OF THE ILLUSTRATED APPARATUS

When the terminals 61 and 63 are connected across the battery 7 as shown, a current flows in the above-described first current loop through the transistor 73, the resistors 31 and 33, the transistor 35, and the receiver resistor 9. The value of this current is determined by the controlled conductivity of the transistor 35. Simultaneously, a current flows in the above-described second current loop through the transistor 73, the resistor 41, the elements 21, 23, and 25 of the barrier 15, the link 13, and the transmitter 3. Due to the conventional construction of the latter, the value of the current which flows in the second loop is determined substantially solely by the value of the condition to which the transmitter is responsive.

Due to the respective connections of the amplifier input terminals 47 and 51 to the lower ends of the resistors 31 and 41, the amplifier 49 so controls the transistor 35, and hence the value of the first loop current, as to maintain a predetermined ratio between the value of the first loop current and the value of the second loop current which is established by the transmitter 3. The transistor 35 thus acts as a current controlling means in this first loop to determine the value of the current in that loop. Since that current is the current which flows through the receiver resistor 9, the above-noted maintenance of the predetermined ratio between the two loop currents causes the device 11 to provide the desired faithful reproduction of the existing value of the condition sensed by the transmitter 3.

The value of the above-noted current ratio is determined by the ratio of the resistance values of the resistors 31 and 41. For example, when those resistance values are equal, the transistor 35 adjusts the value of the first loop current as necessary to maintain that value substantially equal to the value of the second loop current established by the transmitter 3. As a result, the receiver resistor current is then kept substantially equal to the transmitter current. Since it is usually desirable in practice to have such a unity ratio between the transmitter and receiver currents, it will be assumed for convenience in the remainder of the present description that this is done with respect to the illustrated apparatus, and that the resistance values of the resistors 31 and 41 are thus equal.

The operation which has been described so far is like that which is performed by the current controlling portion of the apparatus disclosed in the above-noted Saul et al patent. Also, the advantages gained by the use of such a current controlling arrangement in the illustrated apparatus are the same as those obtained in the Saul et al patent apparatus and described therein—namely, the ability to ground both the transmitter and the receiver and to use ground as one of the link conductors, and the ability to obtain full intrinsic safety by the use of only a single barrier between the receiver and the link and transmitter.

The operation of the transistor 73, and of the other components of the voltage controlling portion of the apparatus 1 which control the transistor 73, maintains constant, at a predetermined value, the voltage at a specific point in the first loop. That point is the point 99, which is the junction between the lower end of the resistor 33 and the emitter of the transistor 35. In so maintaining a constant voltage at the point 99, the voltage controlling portion monitors the voltage at the point 99 and correspondingly adjusts the conduction of, and hence the voltage drop across, the transistor 73.

Specifically, a portion of the voltage at the point 99, dependent in value upon the position of the adjustable contact on the resistor 77, is applied to the base of the transistor 81. This occurs because the upper end of the resistor 75 is connected to the point 99 through the base-emitter junctions of the transistors 35 and 55, and because the base-emitter voltage drops of the forward conducting transistors 35 and 55 are substantially constant. Also, the voltage on the base of the transistor 83 is held constant by the action of the Zener diode 87.

The transistor pair 81–83 amplifies any difference between the voltages on the bases of the transistors 81 and 83, and the amplified difference voltage is applied to the base of the transistor 73. This forms a negative feedback loop such that any variation in the voltage at the point 99 is accompanied by a corresponding variation in the voltage at the top of the resistor 75, and by a proportional variation in the voltage on the base of the transistor 81. Any variation between the latter voltage and the reference voltage on the base of the transistor 83 is amplified and varies the emitter-collector conduction of the transistor 73. This, in turn, produces a proportional variation of all voltages on the two current loops, including, specifically, the voltage at the point 99. In this way, the voltage at the point 99 is maintained constant at a value which is determined by the position of the adjustable contact on the resistor 77. The transistor 73 thus acts as a voltage controlling means which presents a controlled voltage drop in both of the system loops.

As a result of the construction and operation which have been described above, the resistance value of the resistor 33 determines the location of the transmitter loop point in that loop. Stated differently, the value of the resistor 33 defines the point in the second or transmitter loop at which the maintenance of the constant voltage at the point 99 causes a corresponding constant voltage to be held. Thus, the value of the resistor 33 in the receiver or first loop determines and sets the position of the transmitter loop point at which the voltage is kept constant at a value corresponding to the value of the constant voltage maintained at the first loop point 99. In summary, the resistor 33 constitutes the means by which the location of the constant voltage transmitter loop point is established in that loop.

The locating or placing or setting of the transmitter loop point is effected in practice by noting the value of the resistance existing between the lower end of the resistor 41 and the desired position of the transmitter loop point, and then using that value as the resistance value for the resistor 33. Since it is desired in the example of the illustrated apparatus to have the transmitter loop point at the point 101 at the second stage barrier diode 29, the resistance value of the resistor 33 in this example would be equal to the value of the resistance existing between the lower end of the resistor 41 and the point 101.

TYPICAL VALUES

By way of illustration and example, and not by way of limitation, it is noted that apparatus of the form shown in the drawing may well have the following component values:

Battery 7—24 volts (D.C. power supply)
Resistor 9—250 ohms
Fuse 21—50 ma., 13 ohms
Resistor 23—27 ohms
Resistor 25—150 ohms
Zener diode 27—24 volt, 20 watt
Zener diode 29—22 volt, 20 watt
Resistor 31—100 ohms
Resistor 33—40 ohms
Transistor 35—Type 2N4037
Resistor 41—100 ohms
Amplifier 49—Type 741K
Transistor 55—Type 2N4250
Capacitor 57—0.01 mfd.
Resistor 67—205 ohms
Resistor 70—10 Kohms
Diode 71—Type 1N4148
Transistor 73—Type 2N4037
Resistor 75—4.22 Kohms
Resistor 77—1 Kohms
Resistor 79—2.21 Kohms
Transistor 81—Type 2N3904
Transistor 83—Type 2N3904
Resistor 85—1 Kohms
Resistor 86—3.24 Kohms
Zener diode 87—6.2 volt
Resistor 89—1.5 Kohms
Resistor 91—3.16 Kohms
Resistor 93—10 Kohms
Capacitor 95—0.1 mfd.
Capacitor 97—0.1 mfd.
Transmitter 3 and resistor 9 currents—4 ma.-20 ma.
Receiver device 11 voltage—1 volt-5 volts.

It is believed to be clear from the foregoing description that the described apparatus fulfills the objects stated herein. Thus, it has been shown that the described construction provides a desired, constant value for the voltage at a selectable point in a current telemetering system, thereby making it possible to choose that point so that Zener barrier diode tripping is avoided without unduly limiting the supply voltage for the system transmitter.

The embodiments of the invention in which an exclusive property or privilege is claimed are defined as follows:

1. In interfaced current telemetering apparatus including a current receiver and a current controller connected in series in a first current loop across a source of current, a current transmitter, an intrinsic safety barrier, and a two-wire link connected in series in a second current loop across said source of current, means for causing said current controller to maintain a predetermined ratio between the values of the currents in said first and second loops, voltage controlling means providing a controlled voltage drop, means connecting said voltage controlling means in series in each of said loops, and responsive means connected to said voltage controlling means and to a first point in said first loop and responsive to the value of the voltage at said point for causing said voltage controlling means to maintain that voltage drop in both of said loops which maintains said voltage at said point substantially constant at a predetermined value, the improvement comprising resistance means connected in said first loop adjacent to said point and having a value which establishes a second point in said second loop at which said voltage drop maintained by said voltage controlling means produces a voltage which is substantially constant at a value corresponding to that of the constant voltage maintained at said first point.

2. Interface apparatus for use with a current receiver which is connected to a current transmitter by a two-wire link and an intrinsic safety barrier, said apparatus comprising first and second terminals arranged to be connected to a source of current, voltage controlling means providing a controlled voltage drop, current controlling means, means connecting said voltage controlling means and said current controlling means in series with a current receiver between said terminals to provide a first current loop wherein a current flows with a value controlled by said current controlling means, means connecting said voltage controlling means, an intrinsic safety barrier, a two-wire link, and a current transmitter in series between said terminals to provide a second current loop wherein a current flows with a value controlled by said transmitter in accordance with the value of a condition sensed by said transmitter, first responsive means connected to said current controlling means and to said first and second loops and responsive to the values of said loop currents for causing said current controlling means to adjust the value of said current in said first loop to maintain a predetermined ratio between the values of said loop currents, second responsive means connected to said voltage controlling means and to a receiver loop point in said first loop and responsive to the value of the voltage at said point for causing said voltage controlling means to maintain that voltage drop in both of said loops which maintains said voltage at said point substantially constant at a predetermined value, and resistance means connected in series in said first loop adjacent to said point to cause the resistance value of said resistance means to establish a transmitter loop point in said second loop at which said voltage drop maintained by said voltage controlling means produces a substantially constant voltage corresponding to that maintained at said receiver loop point.

3. Apparatus as specified in claim 2, wherein said barrier includes a Zener diode connected to said transmitter loop point, and the value of said constant voltage produced at said transmitter loop point is below that value which causes significant Zener conduction of said diode.

4. Apparatus as specified in claim 2, wherein said barrier includes an input stage Zener diode and a second stage Zener diode having a lower Zener voltage rating than said input stage diode, said resistance value of said resistance means locates said transmitter loop point at said second stage diode, and the value of said constant voltage produced at said transmitter loop point is below that value which causes significant Zener conduction of said second stage diode.

5. Interface apparatus for use with a current receiver which is connected to a current transmitter by a two-wire link and an intrinsic safety barrier, said apparatus comprising first and second terminals arranged to be connected to a source of current, voltage controlling means providing a controlled voltage drop, current controlling means, first, second, and third resistors, means connecting said voltage controlling means, said first resistor, said second resistor, said current controlling means, and a current receiver in series in the order stated between said terminals to provide a first current loop wherein a current flows with a value controlled by said current controlling means, means connecting said voltage controlling means, said third resistor, an intrinsic safety barrier, a two-wire link, and a current transmitter in series in the order stated between said terminals to provide a second current loop wherein a current flows with a value controlled by said transmitter in accordance with the value of a condition sensed by said transmitter, first amplifier means having an output connected to control said current controlling means and having an input connected between the junction between said first and second resistors and the junction between said third resistor and said barrier for causing said current controlling means to adjust the value of said current in said first loop to maintain a predetermined ratio between the values of said loop currents, and second amplifier means having an output connected to control said voltage controlling means and having an input connected between a point of reference voltage and a receiver loop point in said first loop at the junction between said second resistor and said current controlling means for causing said voltage controlling means to maintain that voltage drop in both of said loops which maintains said voltage at said point in said first loop substantially constant at a predetermined value, the resistance value of said second resistor establishing a transmitter loop point in said second loop at which said voltage controlling means maintains a substantially constant voltage which corresponds to that maintained at said receiver loop point.

6. Interface apparatus for use with a current receiver which is connected to a current transmitter by a two-wire link and an intrinsic safety barrier, said apparatus comprising first and second terminals arranged to be connected to a source of current, first and second transistors, each having a pair of principle electrodes and a control electrode, first, second, and third resistors, means connecting one of the principle electrodes of said first transistor to said first terminal, means connecting said first resistor, said second resistor, and the principle electrodes of said second transistor in series with a current receiver, in the order stated, between the other of said principle electrodes of said first transistor and said second terminal to provide a first current loop wherein a current flows with a value controlled by said second transistor, means connecting said third resistor, an intrinsic safety barrier, a two-wire link, and a current transmitter in series, in the order stated, between said other principle electrode of said first transistor and said second terminal to provide a second current loop wherein a current flows with a value controlled by said transmitter in accordance with the value of a condition sensed by said transmitter, first amplifier means having an output connected to the control electrode of said second transistor and having an input connected between the junction between said first and second resistors and the junction between said third resistor and said barrier for causing said second transistor to adjust the value of said current in said first loop to maintain a predetermined ratio between the values of said loop currents, and second amplifier means having an output connected to the control electrode of said first transistor and having an input connected between a point of reference voltage and a receiver loop point in said first loop at the junction between said second resistor and said second transistor for causing said first transistor to maintain that voltage drop between its said principle electrodes which maintains said voltage at said point in said first loop substantially constant at a predetermined value, the resistance value of said second resistor establishing a transmitter loop point in said second loop at which said first transistor maintains a substantially constant voltage which corresponds to that maintained at said receiver loop point.

7. Apparatus as specified in claim 6, wherein said first and third resistors have essentially the same resistance value, whereby said constant voltage maintained at said transmitter loop point is equal to said constant voltage maintained at said receiver loop point.

* * * * *